US006220358B1

(12) United States Patent
Leniek, Sr.

(10) Patent No.: US 6,220,358 B1
(45) Date of Patent: Apr. 24, 2001

(54) HOLLOW TUBING PUMPING SYSTEM

(76) Inventor: Humberto F. Leniek, Sr., 2211 Holly Knoll, Houston, TX (US) 77001

( * ) Notice: Subject to any disclaimer, the term of this patent is extended or adjusted under 35 U.S.C. 154(b) by 0 days.

(21) Appl. No.: 09/314,922

(22) Filed: May 19, 1999

(51) Int. Cl.[7] ..... E21B 17/00; E21B 43/12
(52) U.S. Cl. ..... 166/369; 166/68.5
(58) Field of Search ..... 166/369, 68, 68.5, 166/73, 105

(56) References Cited

U.S. PATENT DOCUMENTS

| | | | | |
|---|---|---|---|---|
| 4,476,923 | | 10/1984 | Walling | 166/65 |
| 4,863,991 | | 9/1989 | Poppe et al. | 524/606 |
| 5,180,014 | * | 1/1993 | Cox | 166/68 |
| 5,511,619 | * | 4/1996 | Jackson | 166/68 |
| 5,667,369 | | 9/1997 | Cholet | 417/448 |
| 5,692,562 | * | 12/1997 | Squires | 166/68.5 |
| 5,785,500 | | 7/1998 | Leniek | 417/46 |
| 5,941,311 | * | 8/1999 | Newton | 166/369 |

OTHER PUBLICATIONS

Use Of Small Diameter Casing Reduces Well Costs, M. H. Stekoll et al., World Oil, Feb. 1, 1959, pp. 70–74.

* cited by examiner

*Primary Examiner*—William Neuder
(74) *Attorney, Agent, or Firm*—Conley, Rose & Tayon, P.C.

(57) ABSTRACT

Accordingly, an improved pumping system is herein disclosed. In one embodiment, the pumping system includes a subsurface pump, a tubing string, and a surface pumping unit. The subsurface pump is anchored downhole and driven by repeated upward and downward motion of the tubing string. The subsurface pump pumps fluids to the surface via the tubing string. The upward and downward motion of the tubing string is imparted by any suitable surface pumping unit such as, e.g. a beam pumping unit or a hydraulic pumping unit. This pumping system advantageously provides for a minimal number of strings downhole, requiring at most only (1) casing and (2) the production tubing. Accordingly, the well may be drilled using a very slender hole, thereby allowing for sharply reduced drilling and production costs.

17 Claims, 4 Drawing Sheets

HOLLOW TUBING PUMPING SYSTEM

BACKGROUND OF THE INVENTION

1. Field of the Invention

This invention relates generally to a system for pumping fluid from a well. More specifically, this invention relates to a system in which a subsurface pump is driven by axial motion of the tubing through which the fluid is produced.

2. Description of Related Art

Two types of tubing are popular in oil wells: threaded tubing and coiled tubing. Threaded tubing consists of fixed lengths of pipe with threaded ends that allow the threaded tubing to be coupled together to form the tubing string. On the other hand, coiled tubing is a long, continuous pipe which is unwound from a spool as it is fed into the well. While each tubing type has its advantages, coiled tubing is generally regarded as more economical. Also, coiled tubing can be used in smaller diameters than threaded tubing.

A significant portion of the oil and gas produced every year is extracted from shallow, low-volume "stripper" wells. Such wells may employ a pump system configuration such as that shown in FIG. 1A. In pump system 400, a wellbore casing 401 extends downward from the surface to various production formations 405. Casing 401 has perforations 410 in the region of the various production formations 405 that allow fluids from these formations to enter the wellbore. A tubing string 402 is situated within casing 401 and also extends downward from a well-head (not shown) to approximately the level of the production formations 405. Located at the terminal end of tubing string 402 is a plunger 404 which resides in a pump chamber 406. The plunger 404 is connected to a solid "sucker rod" string 403, which is in turn connected to a beam pumping unit 408 at the surface. Beam pumping unit 408 raises and lowers the sucker rod 403 to move the plunger 404 in relation to the pump chamber 406. The plunger motion, in conjunction with the operation of check valves 407, causes the transfer of fluids from below the plunger 404 to the annulus between the sucker rod 403 and tubing 402. Repeated raising and lowering of plunger 404 eventually transfers sufficient fluid to fill tubing 402 and to thereafter force fluid to flow from well at the surface, creating a producing well. FIG. 1B shows an enlarged cross-sectional view of the subsurface pump.

The hole that is initially drilled for a well must have a sufficiently large diameter to accommodate at least casing 401, tubing 402, and sucker rod 403, along with any additional clearances required by their couplings. Often additional, larger-diameter casings may also be provided near the surface. Since larger holes require larger drilling equipment, longer drilling times, and higher pipe costs, it is desirable to minimize hole diameters as much as possible without reducing the production rate of the well.

SUMMARY OF THE INVENTION

Accordingly, an improved pumping system is herein disclosed that provides for the elimination of the solid sucker rod, thereby allowing for reduced well diameters and consequently reduced costs. In one embodiment, the pumping system includes a subsurface pump, a tubing string, and a surface pumping unit. The subsurface pump is anchored downhole and driven by repeated upward and downward motion of the tubing string. The subsurface pump pumps fluids to the surface via the tubing string. The upward and downward motion of the tubing string is imparted by any suitable surface pumping unit such as, e.g. a beam pumping unit or a hydraulic pumping unit. This pumping system advantageously provides for a minimal number of strings downhole, requiring at most only (1) casing and (2) the production tubing. Accordingly, the well may be drilled using a very slender hole, thereby allowing for sharply reduced drilling and production costs.

Also disclosed herein is a method for producing fluids from a well. The method includes: (i) attaching a subsurface pump to one end of a reel of continuous tubing; (ii) installing the subsurface pump into a well; (iii) driving the continuous tubing in an up and down axial motion to move a plunger in the subsurface pump accordingly; (iv) transferring fluids from below the plunger to the interior of the continuous tubing; and (v) passing fluids through the continuous tubing to a storage tank above ground. The installation step (ii) includes: (a) unwinding the continuous tubing from the working reel; (b) injecting the continuous tubing into the well; (c) anchoring the subsurface pump near the bottom of the well; and (d) coupling the upper end of the continuous tubing to a pumping unit above ground.

BRIEF DESCRIPTION OF THE DRAWINGS

A better understanding of the present invention can be obtained when the following detailed description of the preferred embodiment is considered in conjunction with the following drawings, in which.

Figure 1A:
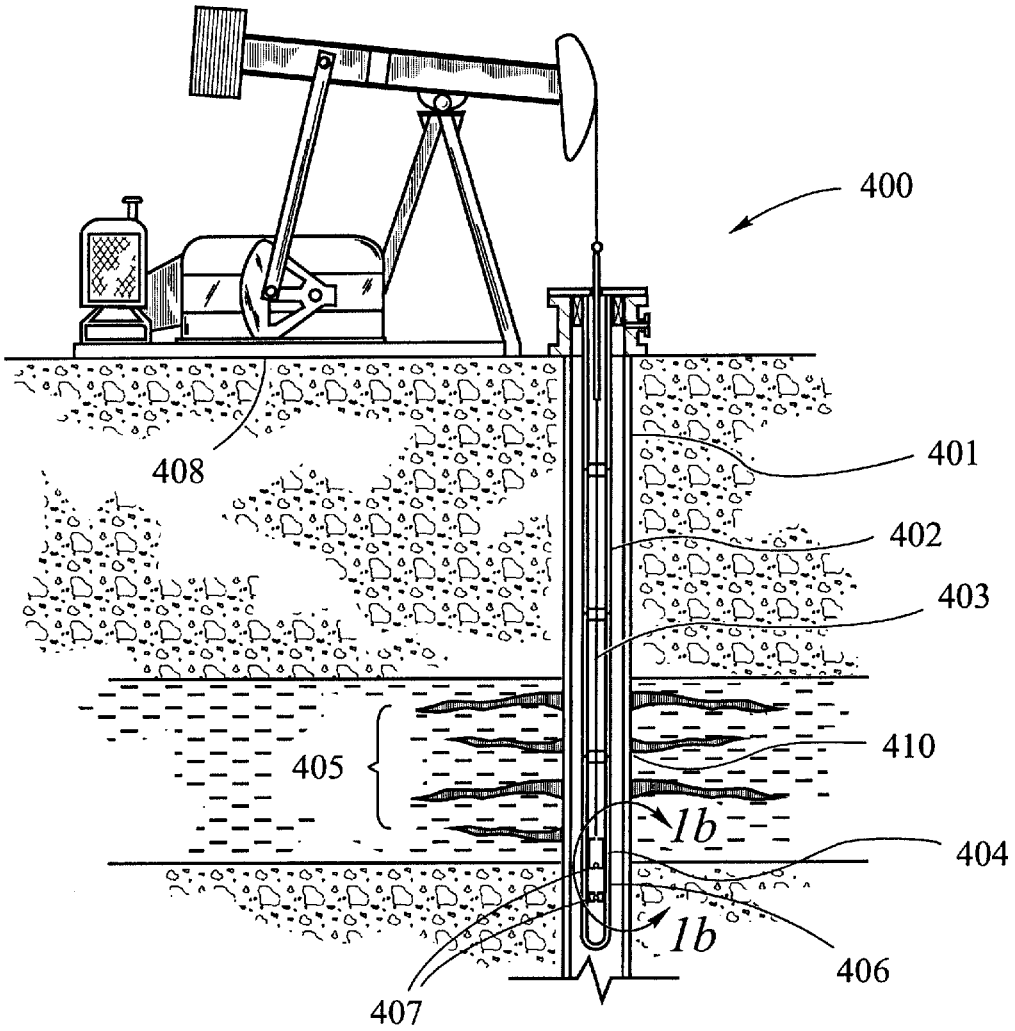
FIG 1a Prior Art
FIG. 1A is a cross-sectional side view of a subterranean well.
Figure 1B:
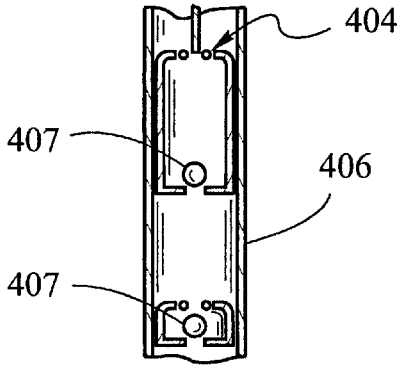
FIG 1b Prior Art
FIG. 1B is a cross-sectional side view of a subsurface pump.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENT

Disclosure Document No. 452,228 filed by Humberto Leniek with the U.S. Patent and Trademark Office under the Disclosure Document program relates to the pumping system described herein, and is accordingly incorporated by reference.

Figure 2:
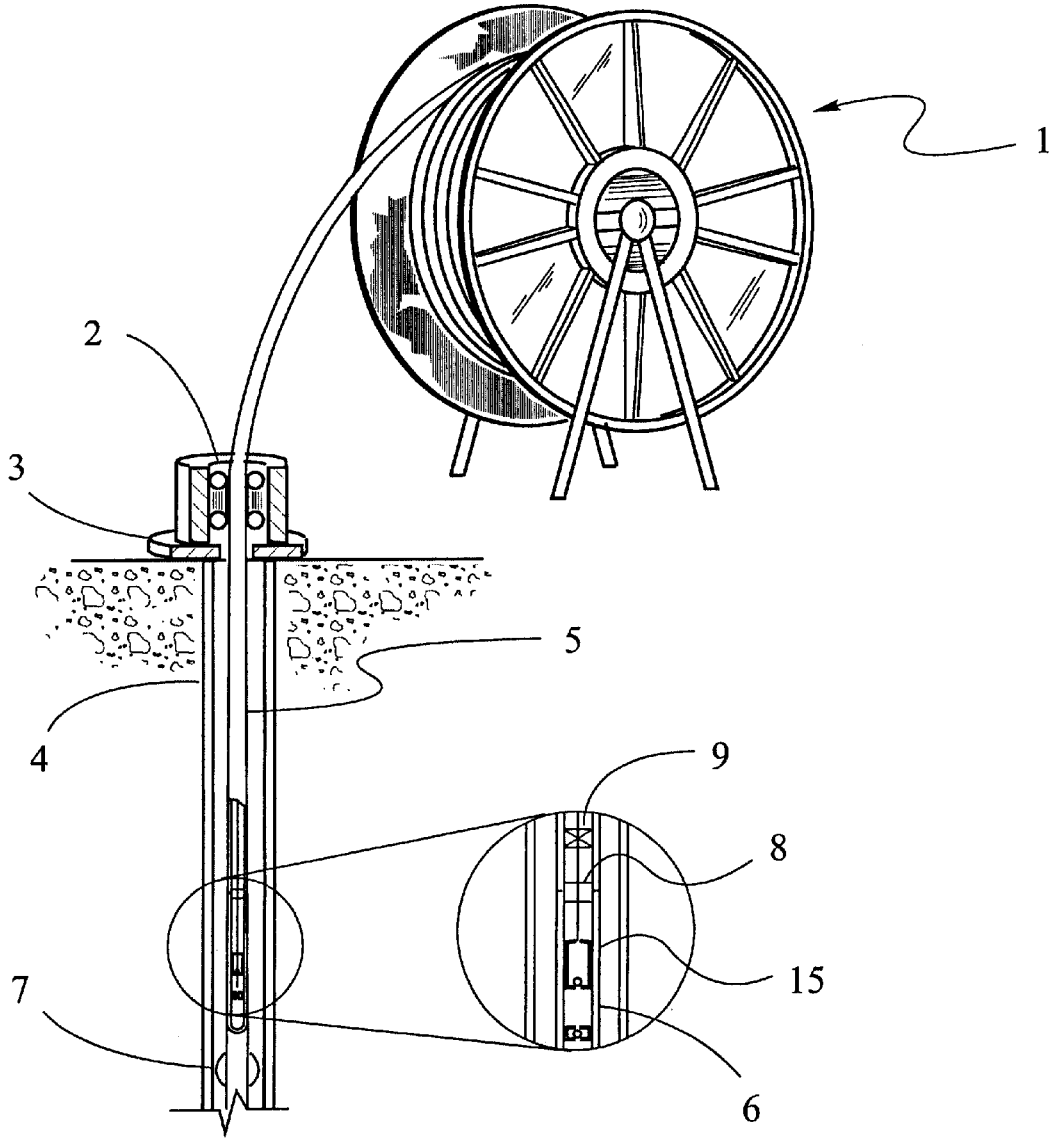
FIG. 2 is a cross-sectional side view showing one method for deploying one embodiment of the present invention.

Referring now to FIG. 2, a preferred method for deploying a subterranean pump is shown. A small-diameter well is drilled and fitted with a single well casing 4 and a well head 3. The well casing 4 is perforated near a producing formation (not shown). A reel 1 of coiled tubing 5 is positioned at the surface. A subsurface hollow rod pump 6 with attached retrievable pump anchor 7 is coupled to the end of the coiled tubing 5 by a roll-on or slip-type tubing connector 8 and lowered into casing 4. The retrievable pump anchor 7 may be of various types, but a preferred type is a Harbison Fisher, Giberson, or other similar retrievable pump anchor type.

A roll-on connector is a hollow cylinder that has circumferential grooves on its exterior. This connector fits inside the bore of the tubing, and a tool is used to crimp the tubing to the connector, thereby making the connection. Connectors of this type typically also include "Orings" which seal the connection against leaks. Roll-on connectors advantageously do not increase the outer diameter of the coiled tubing, and thus do no require any clearance allowances downhole. A slip-type connector is a hollow cylinder that has circumferential ridges on its interior. The ridges are designed to allow the tubing to be inserted into this connector, and to grip the exterior of the tubing to prevent it from subsequently being removed. "O-rings" are also provided in this case to seal the connector against leakage. Tubing connector 8 is preferably connected to the pump 6 by a shear-pin arrangement (not shown) which detaches the tubing from the bottom hole assembly (pump 6 and anchor 7) when sufficient force is applied.

A circulating hydraulic valve 9 may be provided near connector 8. Circulating hydraulic valve 9 may be a spring-loaded one way valve. Valve 9 opens under high pressure to allow fluids from the surface to be conveyed downhole through the coiled tubing 5 and circulated upwards through the annulus around the tubing 5.

A coiled tubing injection head 2 is fitted onto the coiled tubing 5 and used to inject the coiled tubing 5 into the well. The coiled tubing 5 is injected into the well until the pump 6 reaches the appropriate depth. At this point, the pump 6 can be "spaced", i.e. the coiled tubing 5 is suspended by clamps and mechanical slips on the well head 3, and the tubing is cut between the well head 3 and the reel 1. The reel 1 and injection head 2 may then be removed from the well, if desired.

Figure 3:
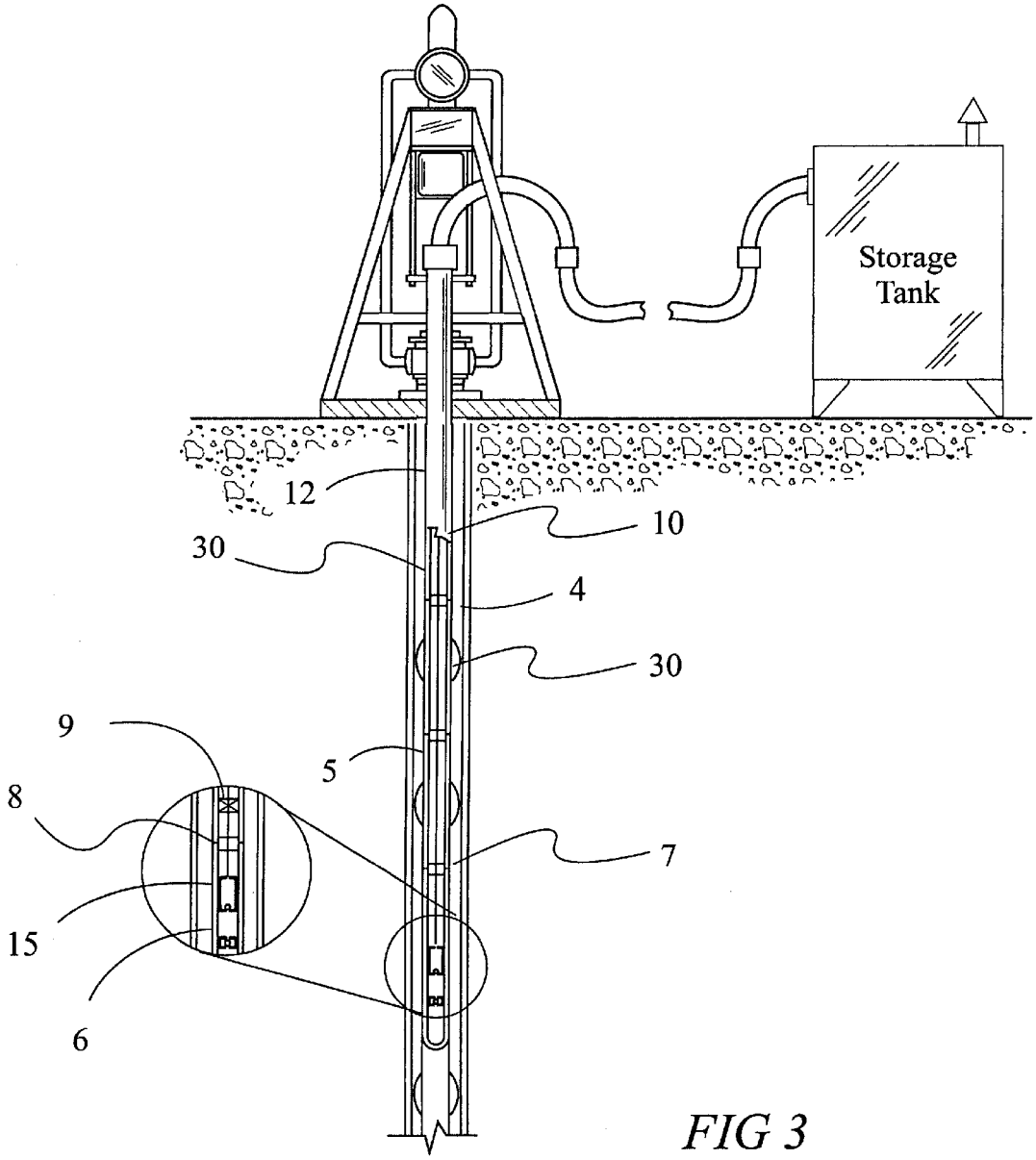
FIG. 3 is a cross-sectional side view of one embodiment of the present invention as deployed.

Referring momentarily to FIG. 3, after the coiled tubing 5 is cut on the surface, an upper connector 10 of the roll-on or slip type is attached to the free end of the coiled tubing 5. The threaded upper end of connector 10 is then connected to the lower end of a hollow polished rod 12, while the upper end of the hollow polished rod 12 is held in position by a winch line or crane (not shown). The connector 10 is then lowered into the well. The hollow polished rod will form a low-friction seal with packing material in the well head, whereby the coiled tubing can be lifted and lowered without breaking the seal.

It is noted that in an alternate embodiment, upper connector 10 is eliminated and the hollow polished rod 12 is replaced by a polished sleeve placed over a portion of the coiled tubing 5. The polished sleeve may comprise chrome-plated steel, stainless steel, or some other suitable material that forms a durable, low friction seal with the well head. The sleeve may be mounted using adhesive or a mechanical seal.

Next, the pump anchor 7 is set. This may be accomplished by maneuvering the coiled tubing string 5 according to established techniques for setting downhole anchors. For example, slips on the anchor may be extended electrically, hydraulically, or frictionally (e.g. by rotating the coiled tubing). The extended slips are then set by allowing some weight to rest on the bottom hole assembly.

Figure 4:
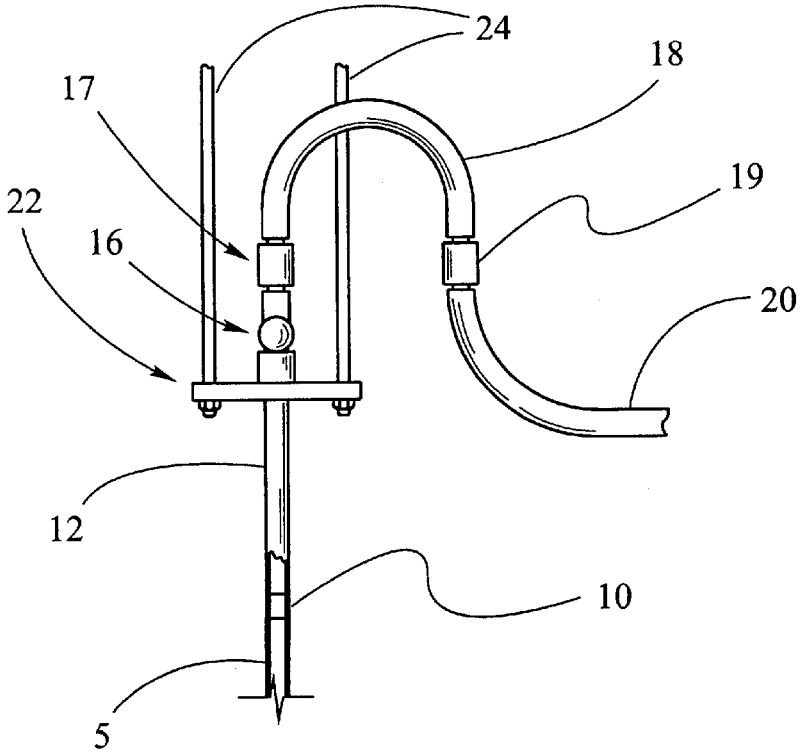
FIG. 4 is a cross-sectional side view of a well surface configuration.

Referring now to FIG. 4, the upper end of polished rod 12 is equipped with a safety valve 16 and preferably connected to an inverted "U" shaped tube 18 by a quick hydraulic connector 17. The "U" shaped tube 18 is preferably connected in turn to a hydraulic high pressure hose 20 by a second quick hydraulic connector 19. The "U" shaped tube 18 is expected to minimize flexural fatigue of the high pressure hose 20. The tube 18 may be eliminated or replaced with an elbow in some embodiments. The high pressure hose 20 may be connected to a production manifold (not shown). The safety valve 16 is preferably a ball valve.

The well head installation can then be completed by installing all the packing elements (not shown), and connecting the upper end of hollow polished rod 12 to the horse head 25 (FIG. 3) of the surface pumping unit by a bridle head 22 and cables 24. The winch line or crane may then be removed from the polished rod 12.

Figure 5:
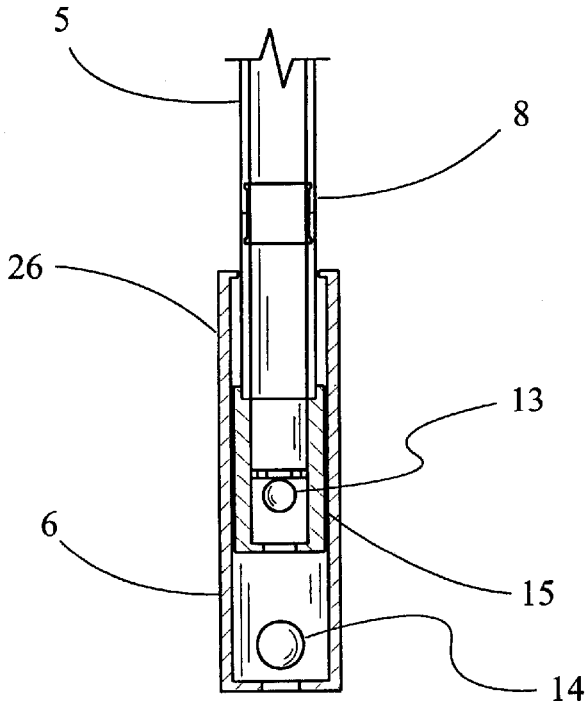
FIG. 5 is a cross-sectional side view of a preferred embodiment of a subsurface pump.

Referring now to FIG. 5, once the installation is complete, the pumping system works in the following manner. Up and down motion of the horse head 24 raises and lowers tubing 5, causing the plunger 15 to move up and down inside the anchored pump housing 26. During the upstroke, the traveling valve 13 is closed by the weight of the fluid in tubing 5. With the traveling valve 13 closed, the upward motion of plunger 15 increases the volume of the chamber beneath valve 13, thereby reducing the pressure and drawing more fluid into the chamber through standing valve 14. At the end of the upstroke, the pump chamber is substantially filled with fluid. During the down-stroke, the standing valve 14 closes. The downward motion of plunger 15 decreases the volume of the pump chamber, thereby increasing the pressure and forcing fluid through traveling valve 13 into tubing 5. At the end of the down-stroke, substantially all the fluid from the pump chamber has been forced into tubing 5. Successive strokes each transfer fluid from the well into the tubing 5 until the fluid level reaches the surface and the well enters the production phase.

Both travelling valve 13 and standing valve 14 are preferably ball and seat valves. The valves open alternately in response to differential pressure in the upward direction, and close in response to differential pressure in the downward direction.

Note that it may be desirable to open the annulus between casing 4 and tubing 5 to the ambient air during the initial "priming" of the well (i.e. the initial fluid fill of the tubing) to prevent an excessive pressure differential from being built up across the pump 6, as this could prevent the "prime" from being established. Once the well has entered the production phase, various parameters such as strokes per minute and stoke length may be adjusted according to bottom hole pressure and dynamic fluid level.

To reduce wear and extend the useful life of the coiled tubing 5, centralizers 30 may be provided at regular intervals as shown in FIG. 3. Alternatively (or additionally) coiled tubing rotators similar to existing rod rotators may be used to distribute wear evenly and thereby extend the useful life of the coiled tubing in this manner. Although the disclosed pumping system is directed primarily to reduced diameter wells, the use of coiled tubing centralizers and coiled tubing rotators provide one method for adapting the disclosed pumping system to wells having larger casing diameters. Such an adaptation would provide an inexpensive method for putting old wells back into production.

Numerous advantages may be obtained by using the disclosed pumping system. For example, a well using the disclosed pumping system may be drilled with a small cross-sectional diameter, i.e. a "slim" or "slender" hole. This allows the use of smaller and less expensive drilling rigs and smaller, lighter, and less expensive pipe. The use of lighter pipe to case a hole requires less hook load capacity in the drilling rig, thus allowing for the reduction of its size and power. The use of smaller drilling rigs advantageously reduce the size of the well location and consequently also reduce environmental impact. Drilling slimmer holes in turn may provide for reduced drilling time and a reduced number of piping strings lowered into the well, and consequently reduced drilling and lifting costs. When coiled tubing is used, the disclosed pumping system may also be used to obtain reduced thread failures due to the elimination of threaded tubing and sucker rods, as well as reduced thread leakage due to the elimination of threaded tubing. Coiled tubing also provides for a diminished possibility of handling-induced since coiled tubing is transported in a reel and used directly from the reel. The reduced number of thread joints also may advantageously provide for reduced "trip" time since workers no longer need to make and break threaded connections as the string is lowered or raised from the well head. Reduced injuries may also be observed since the potential for accidents is significantly reduced when workers are not continually making and breaking threaded joints, and are not repeatedly securing the downhole tubing using elevators, slips, and manual tongs. Additionally, no "workover" rig or derrick man is required, reducing the potential for a fatal fall. In essence, a major advantage of the disclosed pumping system is that it provides for the use of coiled tubing, and accordingly eliminates much of the risk and much of the potential for potential downhole problems.

The scarcity of couplings normally associated with threaded tubing also provides for a unique ability to install the disclosed pumping system under "live well conditions". The continuous cross-section of the coiled tubing allows for better stripping and packing elements at the well head. Accordingly, the disclosed pumping system may provide for the ability to keep the well under control at all times, i.e. eruptions or blow outs may be prevented even when tripping into or out of the hole. Before installing or removing a tubing string in a typical well design, particularly for pressurized wells, it may be necessary to "kill" the well. In other words production is stopped, often by pumping fluids downhole which could potentially damage the producing geological formations.

Another unique ability which may be obtained from the disclosed pumping system is the ability to pump fluid from a multilayered reservoir with a single submerged pump in a monobore well without losing the opportunity to avoid gas lock by unloading or venting undesired gas through the annular space. Fluids from the multiple layers are allowed to flow down the annulus between the casing and the tubing string and to submerge the pump. Gasses flow up the annulus and may be removed from the wellhead at the surface.

Advantageously, the disclosed pumping system is compatible with existing surface installations and equipment including well heads, production manifolds, prime movers and flow lines. The inclusion of the added hydraulic hose assembly is considered to be a minor adaptation to any existing surface installation.

The availability of coiled tubing in different diameters, wall thickness and grades of steel, allows the disclosed pumping system to be adapted for various pump depths, various well fluids, and various pumping volumes.

Numerous variations and modifications will become apparent to those skilled in the art once the above disclosure is fully appreciated. For example, threaded tubing may be used in place of coiled tubing. The tubing may be made of steel or composite materials (composite tubing). In fact, for highly corrosive environments, composite tubing may be preferred.

Additionally, this pumping system may be powered by means other than a beam pumping unit. For example, a hydraulic pumping unit may replace the beam pumping unit. One suitable hydraulic pumping unit is disclosed in U.S. Pat. No. 5,785,500 entitled "Well pump having a plunger in contact with well and pump fluid" and filed May 2, 1996, by inventor Humberto Leniek. This patent is incorporated herein by reference. It is intended that the following claims be interpreted to embrace all such variations and modifications.

What is claimed is:

1. A pumping system which comprises:

a coiled-tubing string;

a surface pumping unit configured to repeatedly raise and lower the coiled-tubing string;

a subsurface pump anchored downhole, wherein the coiled-tubing string is coupled to a plunger in the subsurface pump to raise and lower the plunger as the coiled-tubing string is raised and lowered.

2. The pumping system of claim 1, wherein the subsurface pump further includes a pump housing within which the plunger moves, wherein the pump housing includes a standing valve that transfers fluid to a pump chamber during upward motion of the plunger, and wherein the plunger includes a travelling valve that transfers fluid from the pump chamber to the coiled-tubing string during downward motion of the plunger.

3. The pumping system of claim 2, wherein the standing valve and the travelling valve are ball-and-seat valves.

4. The pumping system of claim 1, wherein the surface pumping unit is a beam pumping unit.

5. The pumping system of claim 1, wherein the surface pumping unit is coupled to the coiled-tubing string by a hollow polished rod that conveys upward and downward motion to the coiled-tubing string.

6. The pumping system of claim 1, further comprising centralizers attached to the coiled-tubing string and configured to reduce contact between the coiled-tubing string and a well casing.

7. The pumping system of claim 1, further comprising a retrievable anchor configured to anchor the subsurface pump downhole.

8. The pumping system of claim 1, wherein the coiled-tubing string is composite tubing.

9. A pumping system which comprises:

a coiled-tubing string;

a surface pumping unit configured to repeatedly raise and lower the coiled-tubing string; and a subsurface pump anchored downhole, wherein the coiled-tubing string is coupled to a plunger in the subsurface pump to raise and lower the plunger as the coiled-tubing string is raised and lowered, wherein the surface pumping unit is coupled to the coiled-tubing string by a hollow polished rod that conveys upward and downward motion to the coiled-tubing string, and wherein the hollow polished rod is configured to convey fluid from the coiled-tubing string via an interior passage to a hydraulic hose, wherein the hollow polished rod is connected to the hydraulic hose by an inverted U-shaped connector.

10. A method for pumping fluid from a well, wherein the method comprises:

attaching a subsurface pump to one end of a continuous tubing string;

lowering the subsurface pump into a cased well;

injecting the continuous tubing string until the subsurface pump reaches a desired location;

anchoring the subsurface pump downhole; and driving a plunger in the anchored subsurface pump via upward and downward motion of the continuous tubing string.

11. The method of claim 10, further comprising:

after injecting the continuous tubing string, severing the continuous tubing string to a desired length;

coupling a hollow polished rod to the continuous tubing string; and lowering the continuous tubing string and a portion of the hollow polished rod into the cased well.

12. The method of claim 11, further comprising:

after anchoring the subsurface pump, suspending the hollow polished rod from a beam pumping unit; and coupling a hose to an upper end of the hollow polished rod.

13. The method of claim 10, further comprising:

producing fluid through the continuous tubing string.

14. A method which comprises:

attaching a subsurface pump to one end of continuous tubing wound on a reel above ground, wherein the subsurface pump has an attached retrievable anchor;

installing the subsurface pump into a well, wherein said installing includes:

unwinding the continuous tubing from the working reel;

injecting the continuous tubing into the well;

anchoring the subsurface pump near the bottom of the well; and coupling an upper end of the continuous tubing to a pumping unit above ground;

driving the continuous tubing in an up and down axial motion to move a plunger in the subsurface pump accordingly;

transferring fluids from below the plunger to an interior of the continuous tubing; and passing fluids through the continuous tubing to a storage tank above ground.

15. The method of claim 14, wherein the pumping unit is connected to the continuous tubing by a hollow polished rod.

16. A method which comprises:

installing a subsurface pump into a live well, wherein said installing includes:

unwinding continuous tubing from a working reel, wherein a lower end of the continuous tubing is attached to the subsurface pump;

injecting the continuous tubing into the well through a stripping element, thereby preventing uncontrolled pressure escape;

anchoring the subsurface pump near the bottom of the well; and coupling an upper end of the continuous tubing to a pumping unit above ground;

driving the continuous tubing in an up and down axial motion to move a plunger in the subsurface pump accordingly;

transferring fluids from below the plunger to an interior of the continuous tubing; and passing fluids through the continuous tubing to a storage tank above ground.

17. The method of claim 16, wherein the fluids are derived from a multi-layered reservoir.

* * * * *